US006257340B1

(12) United States Patent
Vician

(10) Patent No.: US 6,257,340 B1
(45) Date of Patent: Jul. 10, 2001

(54) FIRE EXTINGUISHING SYSTEM USING SHOCK TUBE

(75) Inventor: Theodore E. Vician, Royal Oak, MI (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/606,099

(22) Filed: Jun. 26, 2000

(51) Int. Cl.[7] ..... A62C 35/00; A62C 35/02

(52) U.S. Cl. ..... 169/5; 169/11; 169/26

(58) Field of Search ..... 169/26, 5, 9, 11, 169/14, 15, 16, 17, 19, 20, 56, 71, 72, 84, 85, 46, 47

(56) References Cited

U.S. PATENT DOCUMENTS 4,487,266 * 12/1984 Gillis et al. ..... 169/28
4,779,683 * 10/1988 Enk ..... 169/28
5,465,795 * 11/1995 Galbraith et al. ..... 169/26
5,609,210 * 3/1997 Galbraith et al. ..... 169/26
5,660,236 * 8/1997 Sears et al. ..... 169/85
5,861,106 * 1/1999 Olander ..... 252/7
6,016,874 * 1/2000 Bennett ..... 169/85
6,019,177 * 2/2000 Olander ..... 169/46

* cited by examiner

*Primary Examiner*—David A. Scherbel
*Assistant Examiner*—Davis Hwu
(74) *Attorney, Agent, or Firm*—David L. Kuhn; Gail S. Soderling

(57) ABSTRACT

A rapidly actuating fire extinguishing system incorporates a shock tube construction. The system includes first and second shock-tube sections joined by flanges and sealed from one another by a diaphragm. The first shock tube section contains either fluid under high pressure, or a gas generator or an arc vaporization mechanism. The second shock tube section contains a volatile fluid extinguishant. When the system actuates, the diaphragm is ruptured, so that pressure in the first shock tube section initiates a shock wave that propagates through the extinguishant in the second shock tube section. The shock wave energizes the extinguishant so that it becomes highly pressurized and ruptures a second diaphragm, which is disposed between the second shock tube section and a conduit. The extinguishant then travels along the conduit to a spray head from which the extinguishant is dispersed.

10 Claims, 3 Drawing Sheets

FIRE EXTINGUISHING SYSTEM USING SHOCK TUBE

GOVERNMENT USE

The invention described here may be made, used and licensed by the or for the U.S. Government for governmental purposes without paying me any royalty.

BACKGROUND AND SUMMARY

One of the greatest concerns in the design of US Army combat vehicle is crew protection, and one of the greatest hazards is fire in the vehicle's crew compartment when enemy rounds damage the vehicle. Such a fire is especially dangerous because combat vehicle crew compartments are confined spaces and any fire therein is thus likely to cause injury. In addition, ammunition magazines in the vehicle make any vehicle fire a potential disaster. Consequently, fire extinguishing systems for combat vehicles are designed to act automatically and instantaneously to flood the entire interior of the vehicle once sensors detect a fire.

Traditionally, fire extinguishing systems for combat vehicle use metal bottles containing a highly volatile extinguishant such as Halon 1211 or Halon 1301. The bottle is normally pressurized by compressed nitrogen gas, so that opening a valve in the bottle allows the nitrgen's pressure to expel the extinguishant. However, the US Army is presently attempting to find a replacement for Halon extinguishants because of their adverse environmental impacts.

I have invented a fire extinguishing system that can use either Halon extinguishants or other extinguishants so that little or no modification to the system is required as the Army phases out Halon extinguishants. In addition my system does not require a highly volatile extinguishant to be stored under the same high pressures currently used, which reduces safety concerns. In one embodiment of my invention, no gas or fluid is required to be stored under high pressure so that safety concerns are further reduced and the need to periodically check the fire extinguishing system for proper pressure is eliminated.

My system incorporates a shock tube construction. The system has two shock tube sections joined by flanges and sealed from one another by a diaphragm. The first shock tube section contains either fluid under high pressure or a gas generator, and the second shock tube section contains a volatile, low-boiling-point extinguishant. When the system actuates, the diaphragm is ruptured either by a squib or by a sudden pressure increase in the first shock tube section. The pressure in the first shock tube section propagates a shock wave through the extinguishant in the second shock tube section. The shock wave imparts such enthalpy to the extinguishant that the extinguishant becomes highly pressurized and ruptures a second diaphragm. The second diaphragm is at the opposite end of the second shock tube section from the first diaphragm and is disposed between the second shock tube section and a conduit. After the second diaphragm ruptures, the extinguishant travels along the conduit to a nozzle or spray head from which the extinguishant is dispersed into the vehicle compartment.

DETAILED DESCRIPTION

Figure 1:
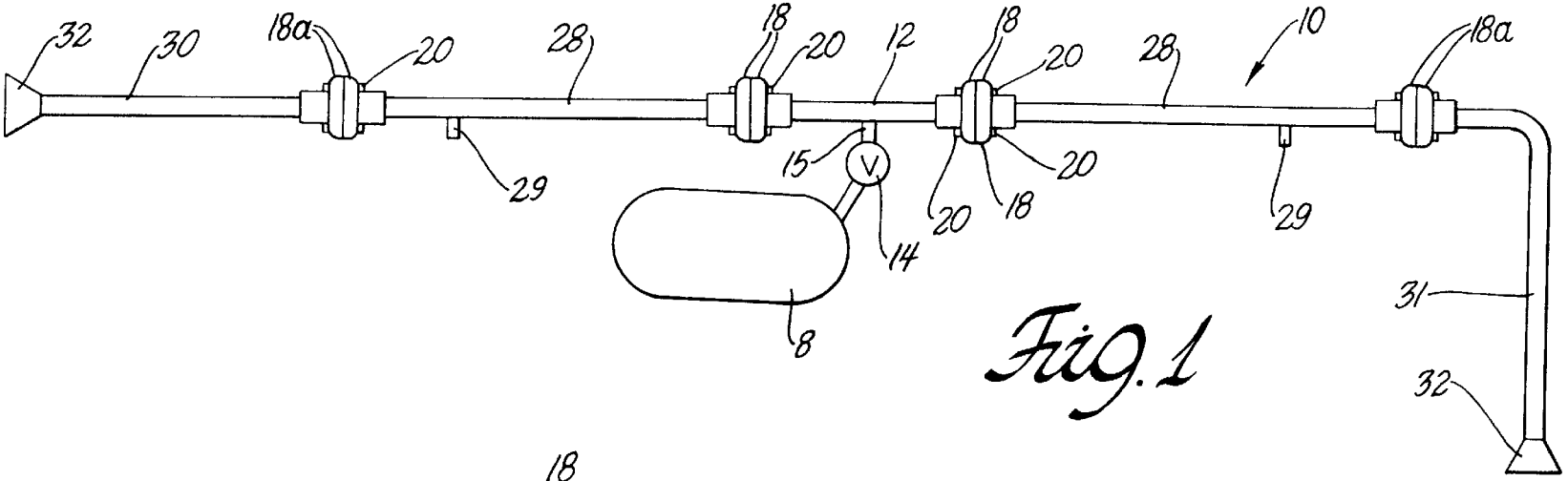
FIG. 1 shows an overview of my fire extinguishing system.
Figure 2:
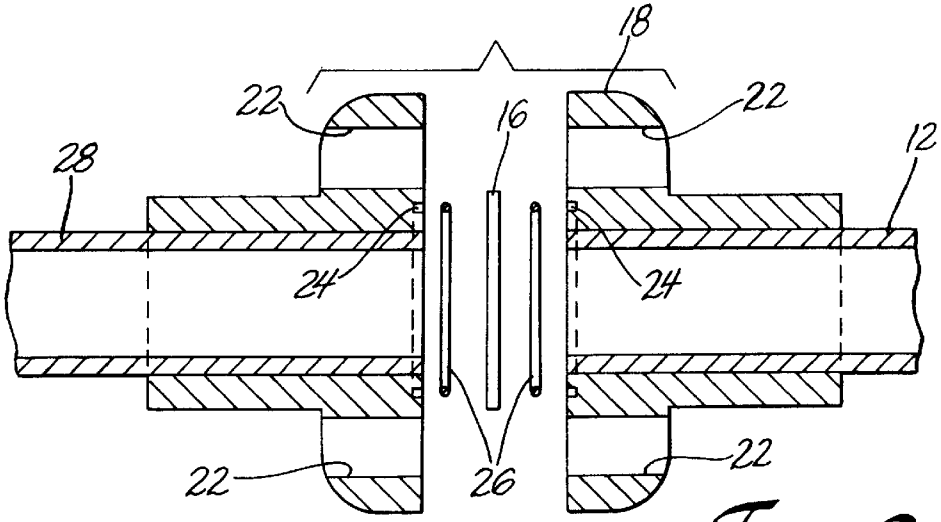
FIG. 2 is a sectioned view of the flanges, diaphragm and seals at the connection between shock tube sections of the system.

In FIG. 1 is shown a rapidly discharging fire extinguishing system 10 incorporating a shock tube construction. System 10 has a shock tube section 12 for containing a driver fluid and a suitable inlet mechanism 15 for admitting the driver fluid to tube section 12 from a high pressure source S. The driver fluid is nitrogen gas under high pressure, typically 750 pounds per square inch, or other pressure found in conventional fire extinguishers where the nitrogen is used to force extinguishant from a bottle. Tube section 12 is closed at either end by a diaphragm comprised of a thin round metal plate 16 shown in FIG. 2, but any known shock tube diaphragm structure can also be used. Plate 16 is held on the end of tube section 12 by flanges 18, which are fastened together by bolts 20 passing through flange holes 22. Flanges 18 define annular grooves 24, which seat O rings 26 that provide a seal between the flanges and plate 16. Flanges 18 fasten tube section 12 to shock tube sections 28. Additional pairs of similar flanges 18*a* connect tube sections 28 with conduits 30 and 31, which lead to spray heads or nozzles 32. The conduits can be bent to configurations suitable to transfer extinguishant to any part of the crew compartment of a military vehicle such as a tank. Between flanges 18*a* are diaphragms similar to plate 16 and seals such as O rings 26, whereby the material in shock tube sections 28 is sealed therein.

Sections 28 hold fire-extinguishing material such as Halon 1211, Halon 1301 or FM 200, a product made by Great Lakes Chemical Corporation. Tube sections 28 are filled with extinguishing material by inlet valves 29 such as Schrader valves or other suitable known inlet valves. The extinguishing material is relatively volatile, has a low boiling point and is stored under pressure so that the material is partly liquefied, as exemplified at reference numeral 4 in FIG. 4. The extinguishant is vaporous in the remaining volume 6 of tube section 28.

Figure 3:
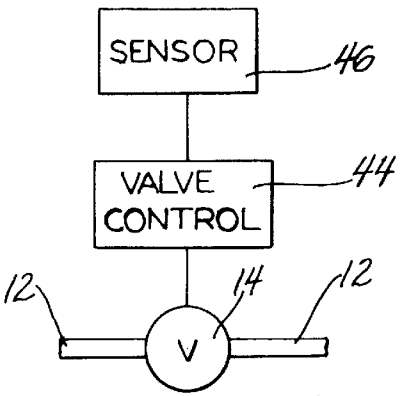
FIG. 3 is a schematic of a valve and control concept that can be used in the system.
Figure 4:
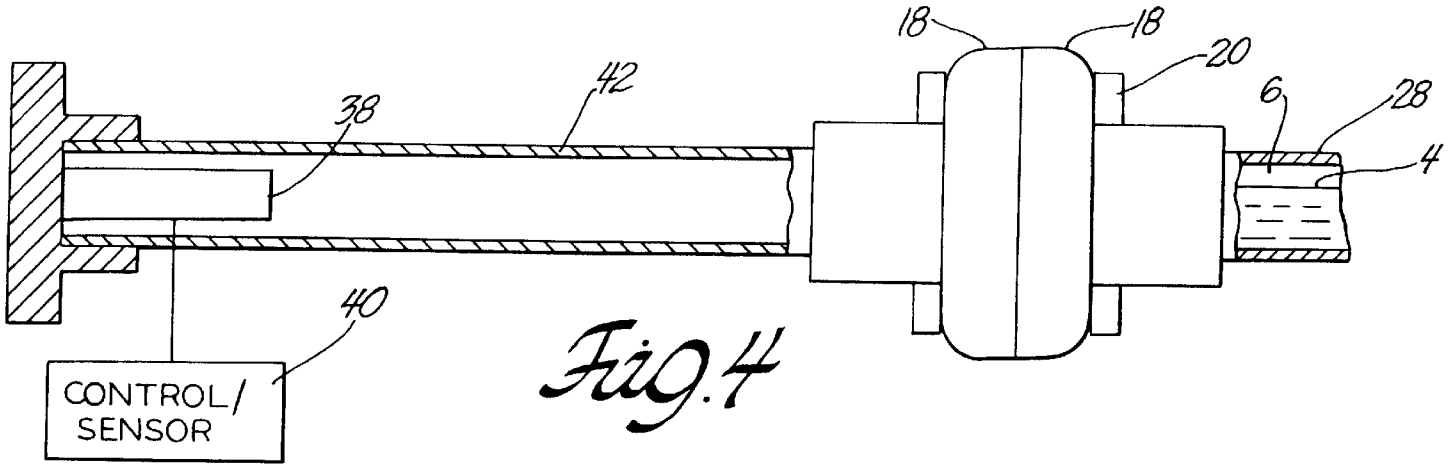
FIG. 4 is shows an embodiment of the system having a gas generator.
Figure 5:
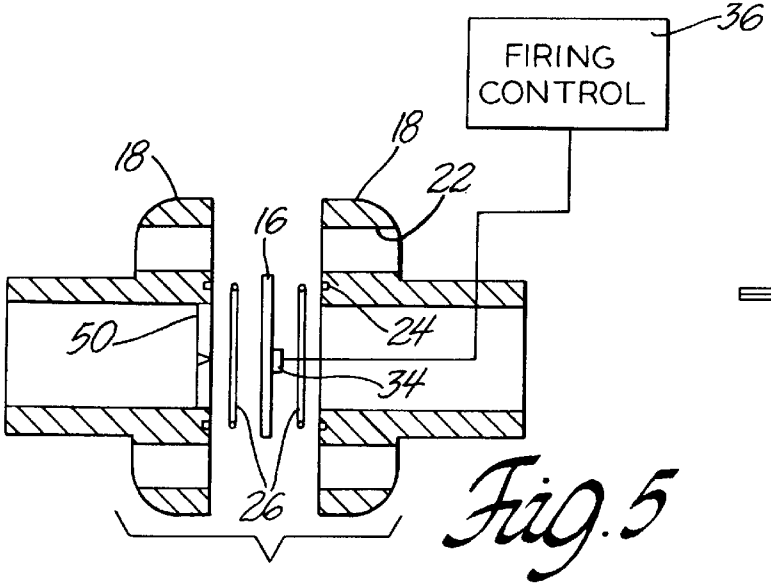
FIG. 5 is a modification to FIG. 2 showing a cutter and a squib on the diaphragm and a firing control mechanism for the squib.

Fire extinguishing system 10 includes a means to initiate a controlled rupture of diaphragms 16 so that the driver fluid in tube section 12 acts upon the driven fluid, which is the extinguishant in tube sections 28. One such means, shown in FIG. 5, is a squib 34 on plate 16, the squib being detonated in response to a signal from a firing control mechanism 36 or other input. Another means to rupture plate 16, shown in FIG. 4, is any suitable known gas generator 38, which can be similar to those used to rapidly inflate automobile air bags. Examples of gas generators are shown in U.S. Pat. Nos. 3,715,131, 3,773,351, 3,827,715 and 4,380,346. Generator 38 activates in response to a signal from a control or sensor mechanism 40 and creates sufficient pressure in a shock tube section 42 to rupture the plate 16 (not shown in FIG. 4) held between flanges 18. In this case, the gas from generator 38 would be the driver fluid. Another option is to make valve 14 (FIG. 1) a rapidly opening valve such as those found in fire extinguishing systems in US Army combat vehicles, wherein a valve control device 44 (FIG. 3) opens valve 14 in response to a signal from light sensor 46. The quick opening of valve 14 will cause a shock of pressure upon plate 16, thereby rupturing it.

Figure 8:
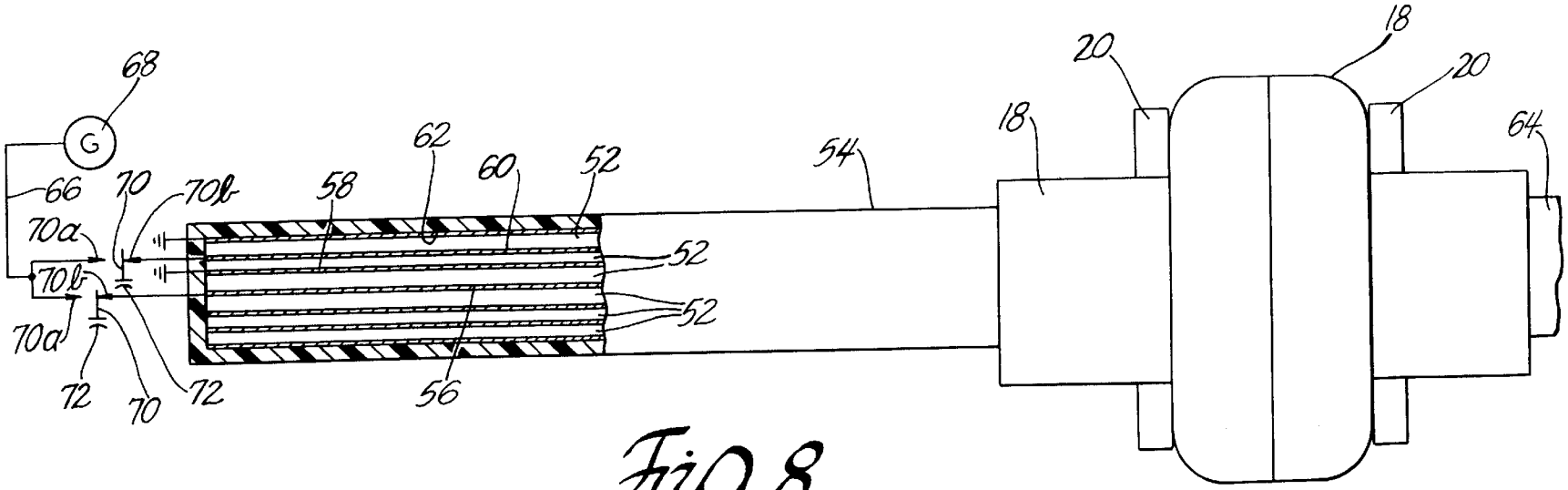
FIG. 8 shows an embodiment of my system having an electric-arc heating mechanism.

Yet another means to provide pressure in the driver fluid to rupture plate 16 is seen in FIG. 8. There, first shock tube section 54 has a central electrode 58 along the axis of the section and has cylindrical electrodes 58, 60 and 62 concentric therewith. A driver fluid, preferably krypton or argon, is normally in a liquid state, and fills spaces 52 between the electrodes. The electrodes are preferably made of heat-resistant material such as tungsten and have a mesh construction so as to maximize the surface contact between the electrodes and the driver fluid. Section 54 is sealed by a plate 16 (not shown in FIG. 8) between flanges 22 as described earlier, and plate 16 seals section 54 from a second shock tube section 64. Associated with tube section 54 is a circuit to control the firing of the electrodes. The circuit has a power input line 66 connected to any suitable source of electrical power such as a generator 68 or batteries. Line 66 branches to a pair of switches having contacts 70*a* and 70*b*. Normally, the switches are in a state where the switch elements engage contacts 70*a* so that generator 68 charges capacitors 72. In FIG. 8, though, the switches are in a state where switch element engage contacts 70*b* such that charges stored in capacitors 72 flow to electrodes 56 and 58. An arc then jumps from electrodes 56 and 58 to electrodes 60 and 62, whereupon the driver liquid vaporizes, bursts plate 16 and sends a shock wave through the extinguishing fluid in tube section 64. As an alternative, the fluid in section 54 can be a liquid fire extinguishing material that will vaporize when the electrodes arc, and the fire extinguishing material will directly enter conduit 30 or 31 (FIG. 1) when plate 16 bursts and will thence pass through spray heads 32.

Figure 7:
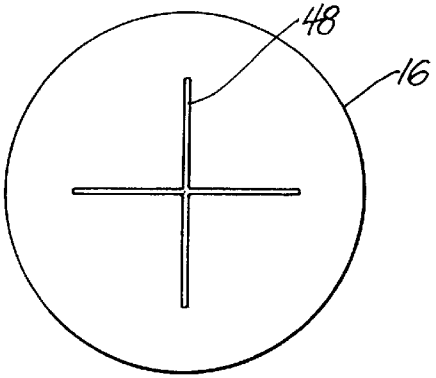
FIG. 7 shows an optional diaphragm for the system.
Figure 6:
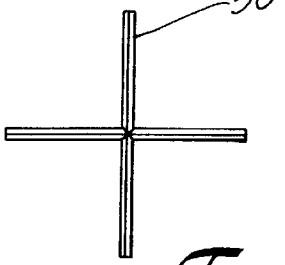
FIG. 6 shows a cutter that may be used in conjunction with the diaphragm in the system.

When plate 16 ruptures, it is desired that the plate will form petals and not fragment. Accordingly, plate 16 will normally be made of a relatively soft, malleable metal such as copper or brass. To facilitate the desired rupture mode, plate 16 may have grooves 48 inscribed on one face, as seen in FIG. 7, whereby plate 16 will rupture into four sectors or petals that do not separate from the plate. As an alternative, a cutter 50 (FIG. 6) may be placed against plate 16 on the side facing the driven fluid, as seen in FIG. 5. As the driving fluid exerts pressure on plate 16 (from the right in FIG. 5), the central portion of the plate will be forced through cutter 50 and be separated into sectors.

In order to actuate fire extinguishing system 10, a high pressure must pre-exist or be created in shock tube section 12. Pre-existing pressure is effected by holding nitrogen or another suitable driver gas at high pressure in tube section 12. Creating high pressure in tube section 12 can be accomplished by opening valve 14 (FIG. 1) so that section 12 is pressurized by source 8, by means of gas generator 38 placed in tube section 12 or by the electric-arc method described above. When tube section 12 is sufficiently pressurized, the plate 16 separating tube sections 12 and 28 is ruptured. In the case where the driver gas is statically held in tube section 12, rupture of the plate is accomplished by detonation of squib 34. In the case of opening valve 14 or using gas generator 38, the increased pressure in tube section 12 can be made sufficient to rupture the plate.

In any event, the driven fluid, the fire extinguishant, in tube section 28 is instantaneously impinged by extremely high-pressure driver fluid from tube section 12. The instantaneous impingement by the driver fluid sends a supersonic shock wave along tube section 28 through the extinguishant, whereby high energy is imparted to the extinguishant. The extinguishant thus becomes much more highly pressurized and ruptures the plate 16 between flanges 18*a* in the same controlled fashion as the plate between flanges 18 was ruptured. The extinguishant then travels to nozzles or spray heads 32. Due to the low boiling point of the extinguishant and the energy imparted to it by the driver fluid, the extinguishant will readily vaporize as it exits the spray heads and thereby will disperse more quickly and completely. Consequently, the extinguishant is more effective against combustion. Optionally, the plate between flanges 18*a* may be designed to rupture only above a certain threshold pressure in tube section 28, thereby ensuring that escaping extinguishant will have at least a minimum energy needed to disperse properly upon exiting the spray heads.

I wish it to be understood that I do not desire to be limited to the exact details of construction or method shown herein since obvious modifications will occur to those skilled in the relevant arts without departing from the spirit and scope of the following claims.

What is claimed is:

1. A fire extinguishing system incorporating a shock tube construction, comprising:

a first shock tube section;

a second shock tube section immediately connected to the first shock tube section;

a first diaphragm separating and sealed with the first section and the second section;

an extinguishant in the second shock tube section;

means for spraying the extinguishant communicated to the second shock tube section;

a second diaphragm separating the second section and the spraying means, the second diaphragm sealed with the second section; and means for propagating a supersonic shock wave through the extinguishant along the second section such that the shock wave sufficiently energizes the extinguishant to rupture the second diaphragm.

2. The system of claim 1 wherein the propagating means comprises a body of gas under high pressure in the first shock tube section and a squib on the first diaphragm.

3. The system of claim 1 wherein the propagating means comprises a gas generator in the first shock tube section.

4. The system of claim 1 wherein the propagating means comprises:

a source of fluid under high pressure; and a rapidly actuating valve communicated to the source and to the second shock tube section.

5. A rapidly actuating fire extinguishing system incorporating a shock tube construction, comprising:

a first shock tube section;

a second shock tube section immediately connected to the first shock tube section;

a first diaphragm separating and sealed with the first section and the second section;

a volatile-fluid extinguishant in the second shock tube section;

a conduit connected to the second shock tube section;

a second diaphragm separating and sealed with the second section and the conduit; and means for propagating a supersonic shock wave through the extinguishant along the second section from the first diaphragm toward the second diaphragm such that the extinguishant is sufficiently energized by the shock wave to rupture the second diaphragm.

6. The system of claim 5 wherein the propagating means comprises a body of gas under high pressure in the first shock tube section and a squib on the first diaphragm.

7. The system of claim 5 wherein the propagating means comprises a gas generator in the first shock tube section.

8. The system of claim 5 wherein the propagating means comprises:

a source of fluid under high pressure; and a rapidly actuating valve communicated to the source and to the second shock tube section.

9. The system of claim 5 wherein the propagating means comprises:

a liquid in the first shock tube that is vaporizable by electric arcing;

a first electrode in the first section;

a second electrode in the first section; and means to produce an arc from the first electrode to the second electrode.

10. The system of claim 5 further comprising means for controlling rupture of the diaphragms such that fragmentation of the diaphragms is prevented.

* * * * *